US011766097B2

(12) United States Patent
Ito et al.

(10) Patent No.: US 11,766,097 B2
(45) Date of Patent: Sep. 26, 2023

(54) BUCKLE AND BUCKLE MALE PART

(71) Applicant: YKK CORPORATION, Tokyo (JP)

(72) Inventors: Naoyuki Ito, Toyama (JP); Ryoichiro Takazakura, Toyama (JP); Tomoko Yagami, Tokyo (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/999,253

(22) Filed: Aug. 21, 2020

(65) Prior Publication Data

US 2021/0059361 A1 Mar. 4, 2021

(30) Foreign Application Priority Data

Aug. 27, 2019 (JP) ..... 2019-155065

(51) Int. Cl.
*A44B 19/26* (2006.01)
*A44B 19/30* (2006.01)
*A44B 11/25* (2006.01)

(52) U.S. Cl.
CPC ..... *A44B 19/305* (2013.01); *A44B 11/2592* (2013.01)

(58) Field of Classification Search
CPC ..... A44B 19/305; A44B 11/2592
See application file for complete search history.

(56) References Cited

U.S. PATENT DOCUMENTS 3,959,858 A * 6/1976 Fukuroi ..... A44B 19/36 24/435
4,395,891 A * 8/1983 Remington ..... A44B 19/301 70/68
5,013,162 A * 5/1991 Williams ..... A44B 19/301 190/120

(Continued)

FOREIGN PATENT DOCUMENTS

CN 102987656 A 3/2013
EP 1300093 B1 8/2007

(Continued)

OTHER PUBLICATIONS

Office Action dated Jun. 10, 2022 from corresponding Chinese patent application No. 202010870623.X, 20 pages.

*Primary Examiner* — Jason W San
(74) *Attorney, Agent, or Firm* — Procopio, Cory, Hargreaves & Savitch LLP

(57) ABSTRACT

A buckle may include male and female parts. In a case (A) where only the female part is attached to a slider of a slide fastener, the male part includes: a pair of arms respectively provided with locking protrusions; and a connecting rod connecting respective base ends of the pair of arms. The connecting rod is configured to curve away from a space between the locking protrusions of the arms when the arms are bent such that the locking protrusions approach one another. In a case (B) where the male part is attached to a slider of a slide fastener, the male part includes: a slider-holding frame configured to hold the slider; and a pair of (Continued)

arms that extend in the same direction from the slider-holding frame and are respectively provided with locking protrusions. The slider-holding frame includes a frame portion protruded into a space between the pair of arms toward a space between the locking protrusions.

9 Claims, 10 Drawing Sheets

(56) References Cited

U.S. PATENT DOCUMENTS 5,031,944 A * 7/1991 Keyaki ..... A44B 19/301 292/307 R
5,355,562 A * 10/1994 Matoba ..... A44B 11/266 24/625
6,510,593 B1 * 1/2003 Kim ..... A44B 19/301 24/382
D526,931 S * 8/2006 Koenig ..... D11/221
7,533,451 B2 * 5/2009 Akashi ..... A44B 19/301 24/386
9,456,663 B1 * 10/2016 Wheeler ..... A44B 19/262
9,888,747 B2 * 2/2018 Smith ..... A44B 19/30
9,902,529 B2 * 2/2018 Reinders ..... A44B 19/305
9,968,166 B2 * 5/2018 Inukai ..... A44B 19/265
10,212,992 B2 * 2/2019 Honda ..... A44B 19/26
10,251,454 B2 * 4/2019 Kojima ..... A44B 19/262
10,492,572 B1 * 12/2019 Omote ..... A44B 19/32
11,154,120 B2 * 10/2021 Rawstron ..... A44B 19/34
11,304,481 B1 * 4/2022 Renner, II ..... A44B 11/2526
2007/0033776 A1 2/2007 Yoneoka
2007/0113384 A1 * 5/2007 Ortlieb ..... A44B 19/32 24/385
2008/0178438 A1 * 7/2008 Yoshie ..... A44B 11/266 24/616
2008/0196217 A1 * 8/2008 Eschbach ..... A44B 19/262 24/386
2009/0106951 A1 * 4/2009 Edwards ..... A44B 19/26 24/386
2010/0306976 A1 * 12/2010 Kaneko ..... A44B 11/2592 24/700
2012/0159746 A1 * 6/2012 Matsumoto ..... A44B 19/26 24/386
2015/0237973 A1 * 8/2015 Kojima ..... A44B 19/262 24/429
2015/0374075 A1 * 12/2015 Smith ..... A44B 19/30 24/418
2018/0289113 A1 * 10/2018 Chu ..... A44B 11/266
2019/0090596 A1 * 3/2019 Huyke-Phillips ..... B65D 33/2591
2019/0142116 A1 * 5/2019 Cheng ..... A44B 19/34 24/389

FOREIGN PATENT DOCUMENTS

JP 3034852 B1 4/2000
JP 2006304942 A 11/2006
JP 2007044535 A 2/2007
JP 4614140 B2 1/2011
JP 5170889 B2 3/2013
JP 6035342 B2 11/2016
WO 2005089583 A1 9/2005

* cited by examiner

[Fig. 1]
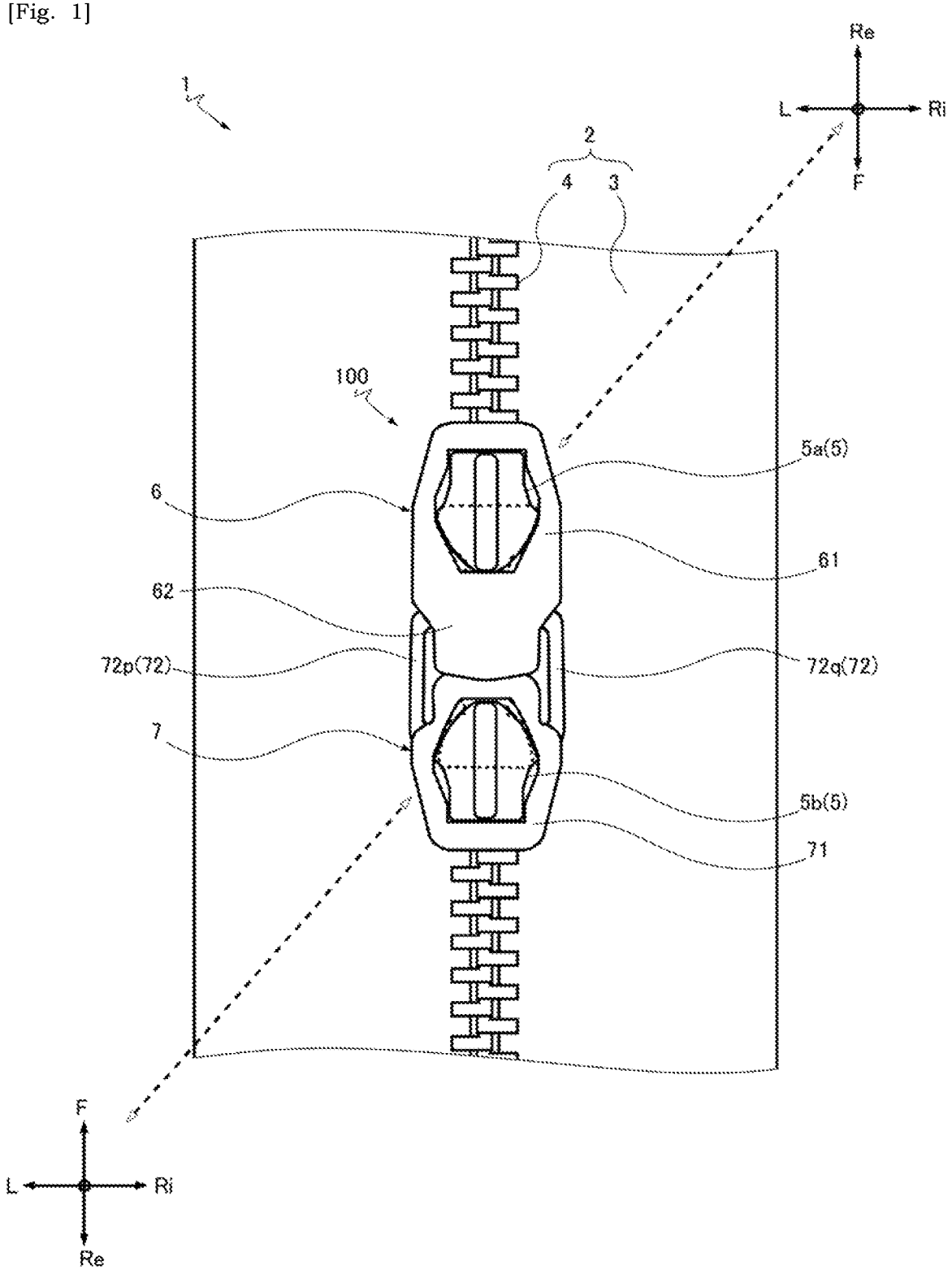

[Fig. 2]
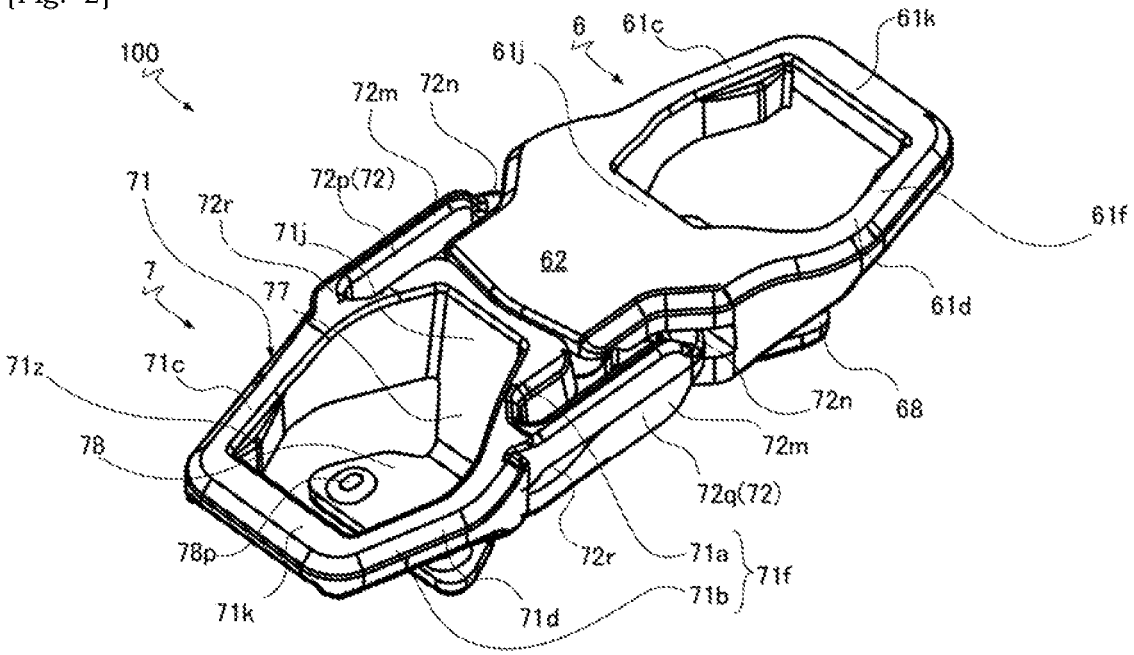
[Fig. 3]
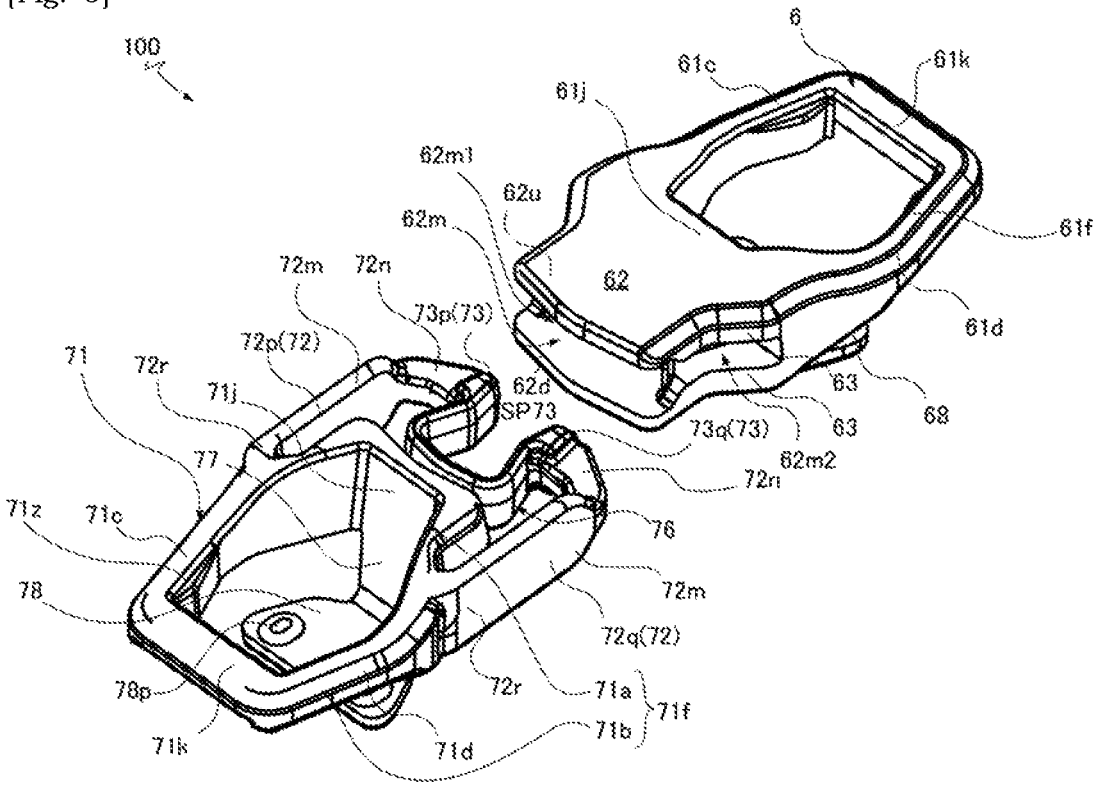

[Fig. 4]
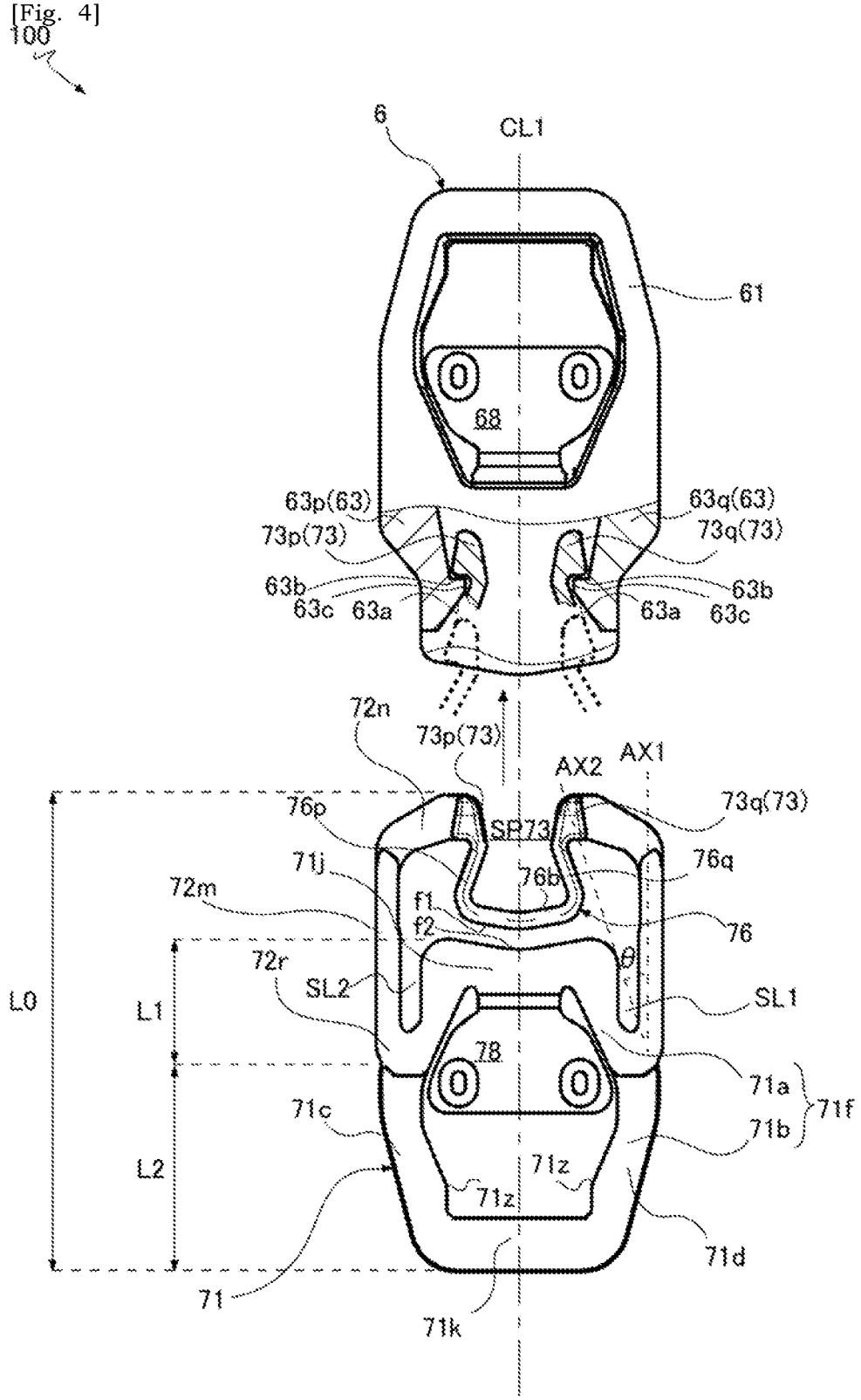

[Fig. 5]
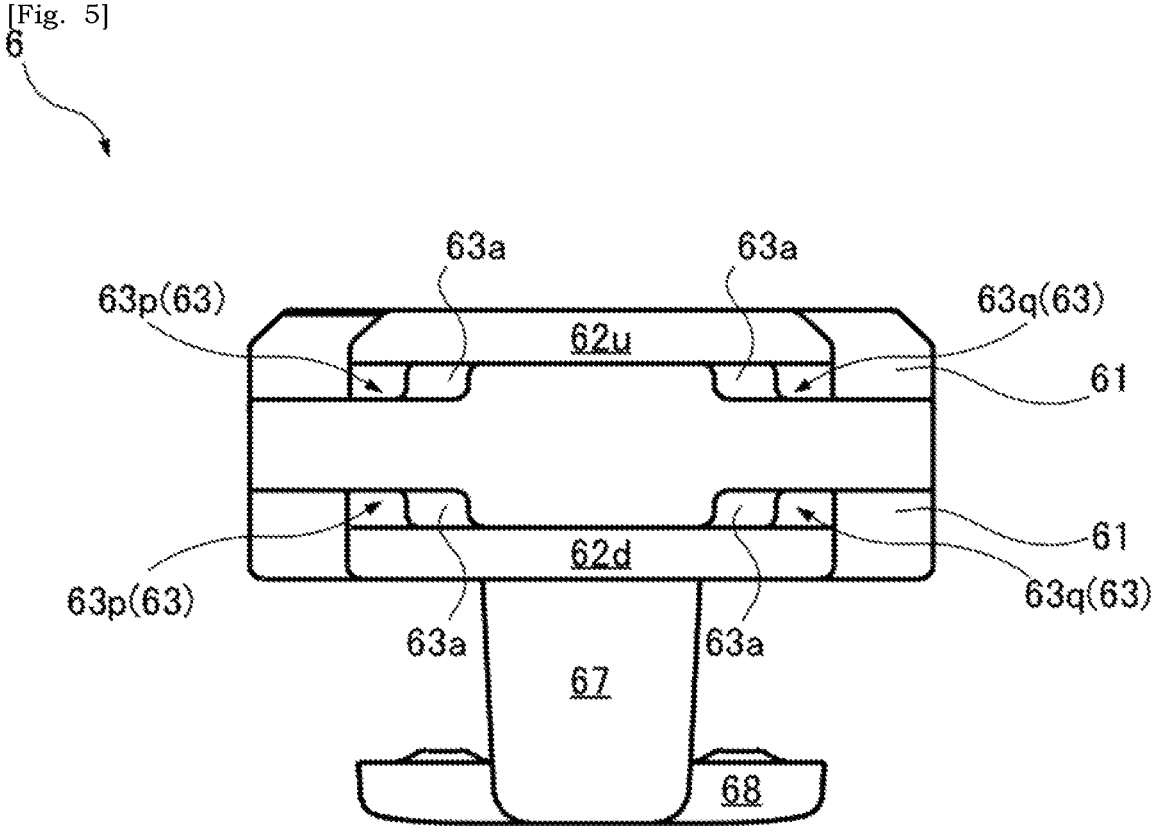
[Fig. 6]
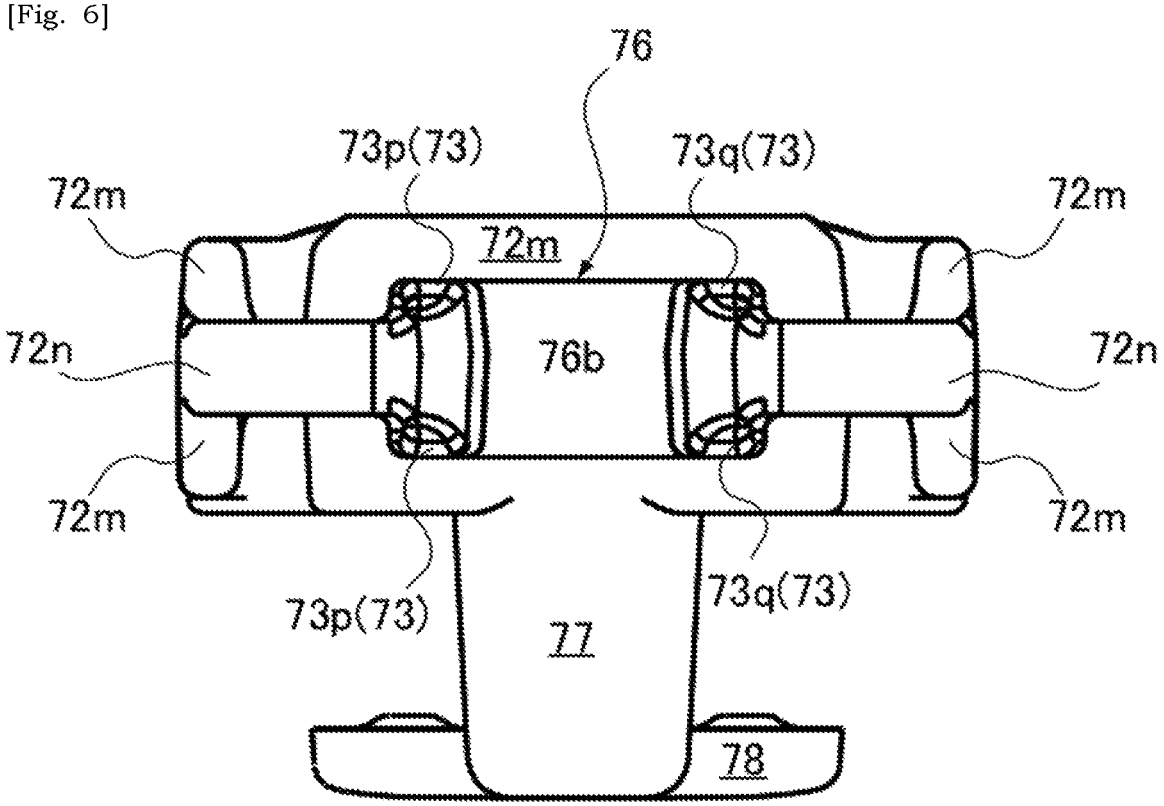

[Fig. 7]
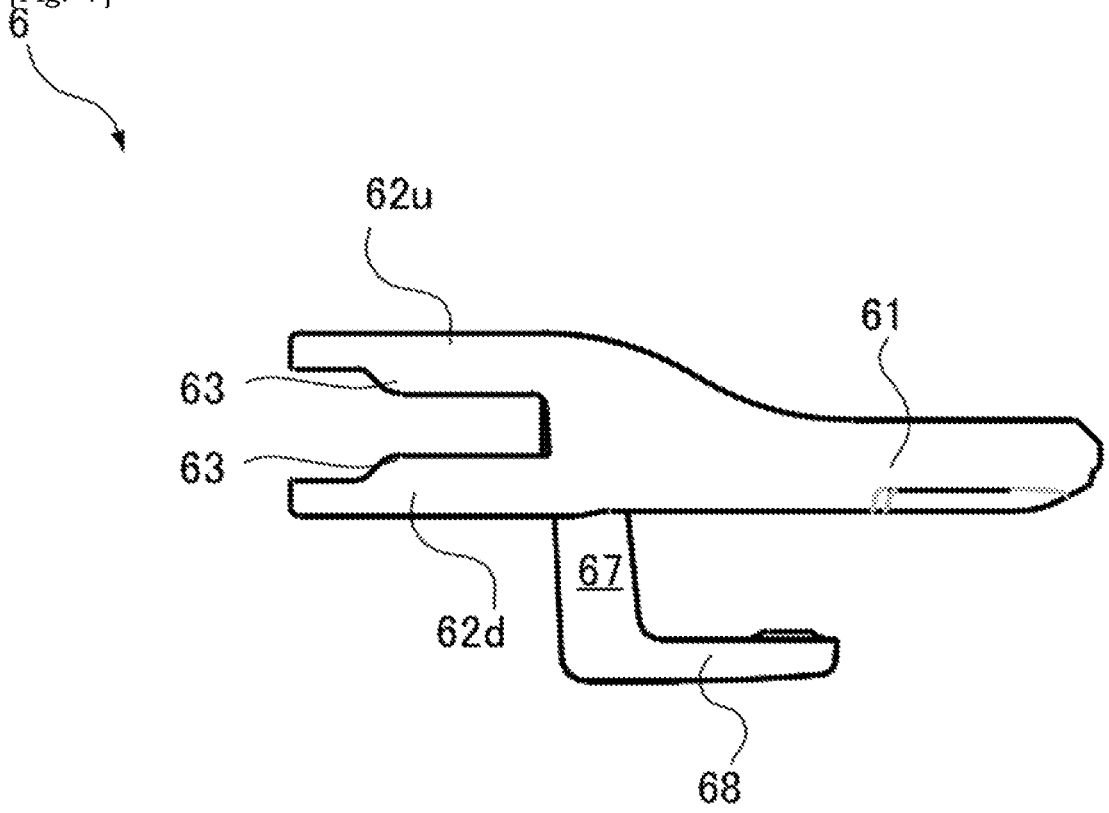
[Fig. 8]
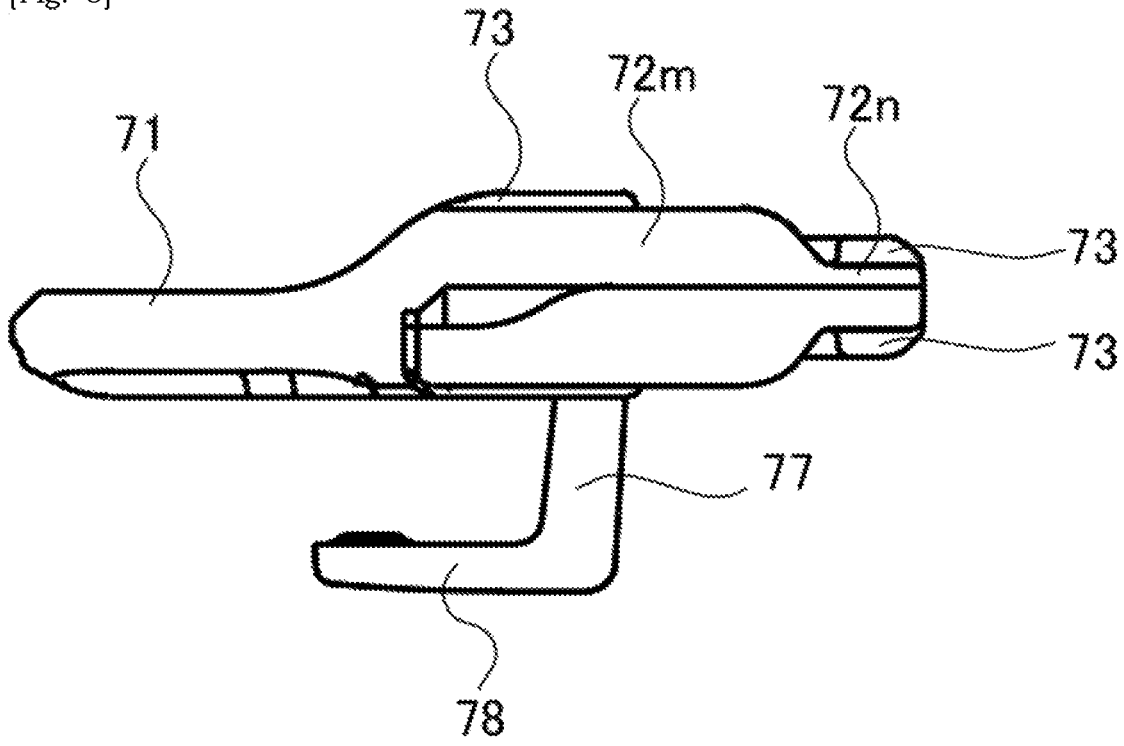

[Fig. 9]
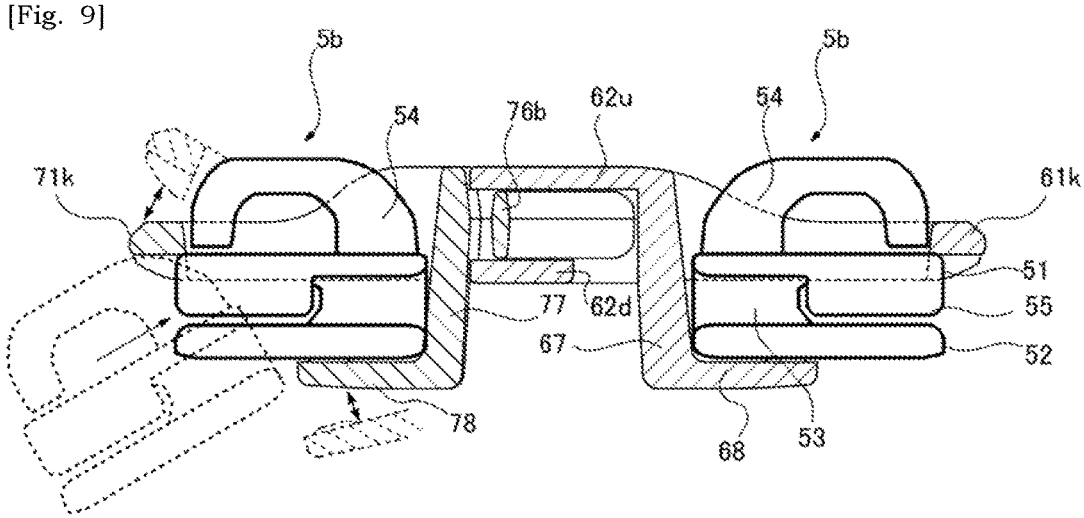
[Fig. 10]
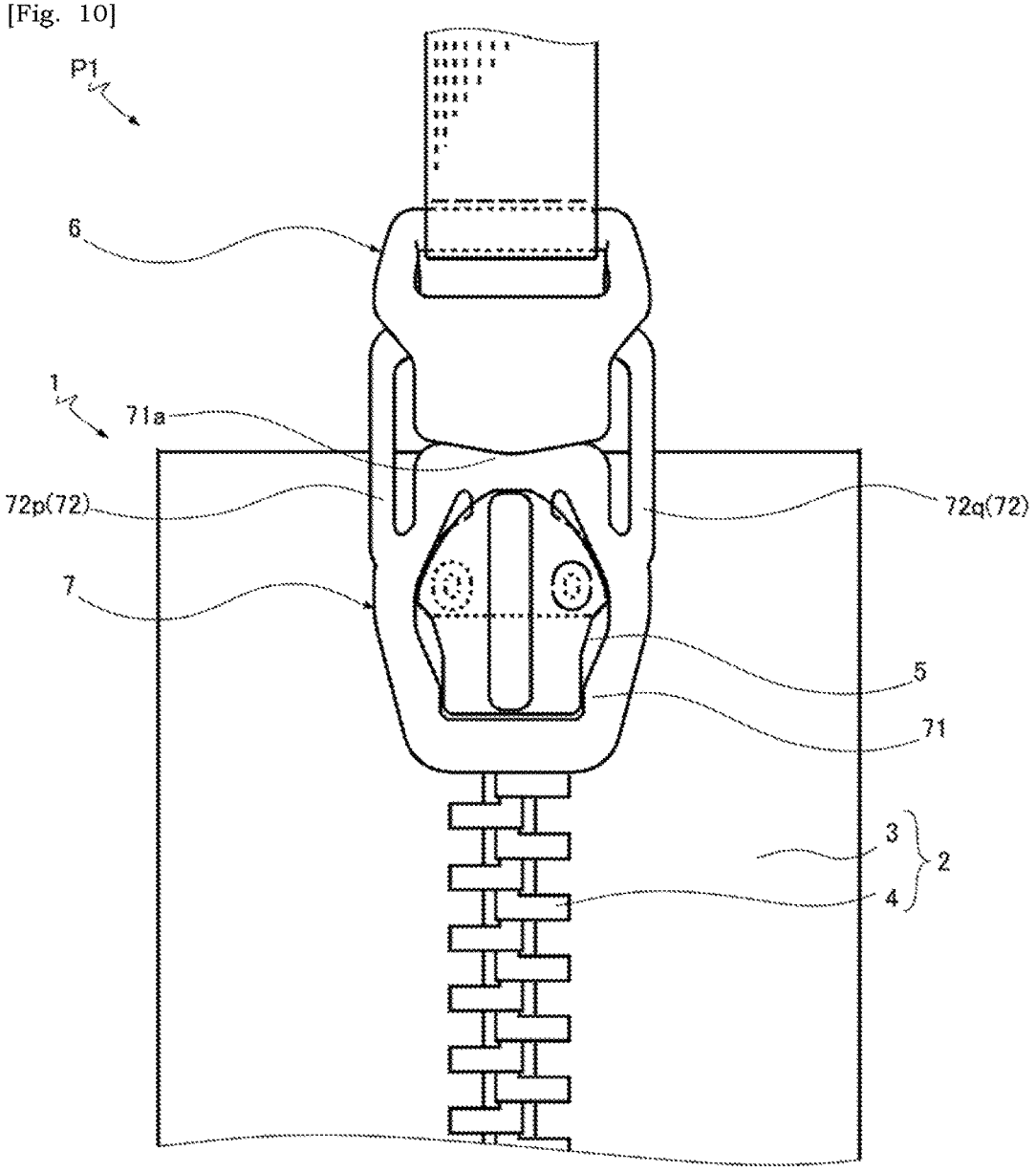

[Fig. 11]
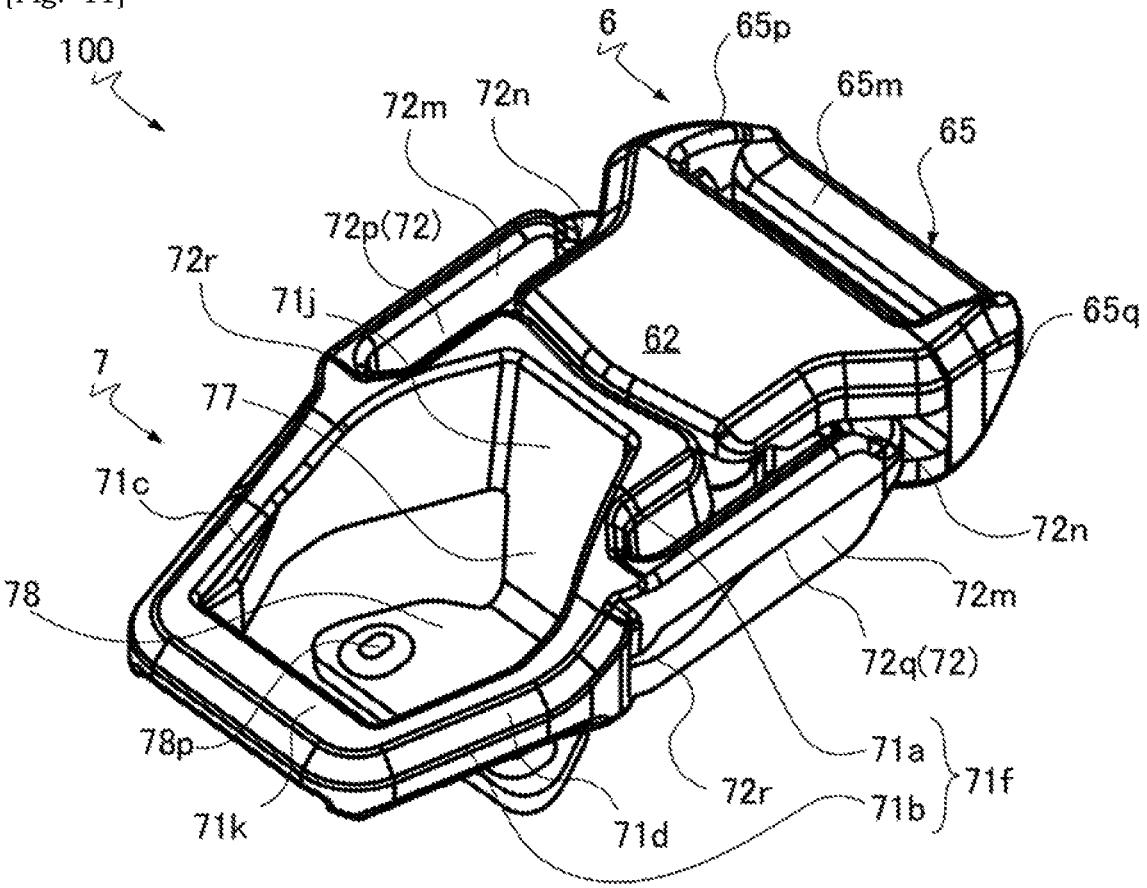
[Fig. 12]
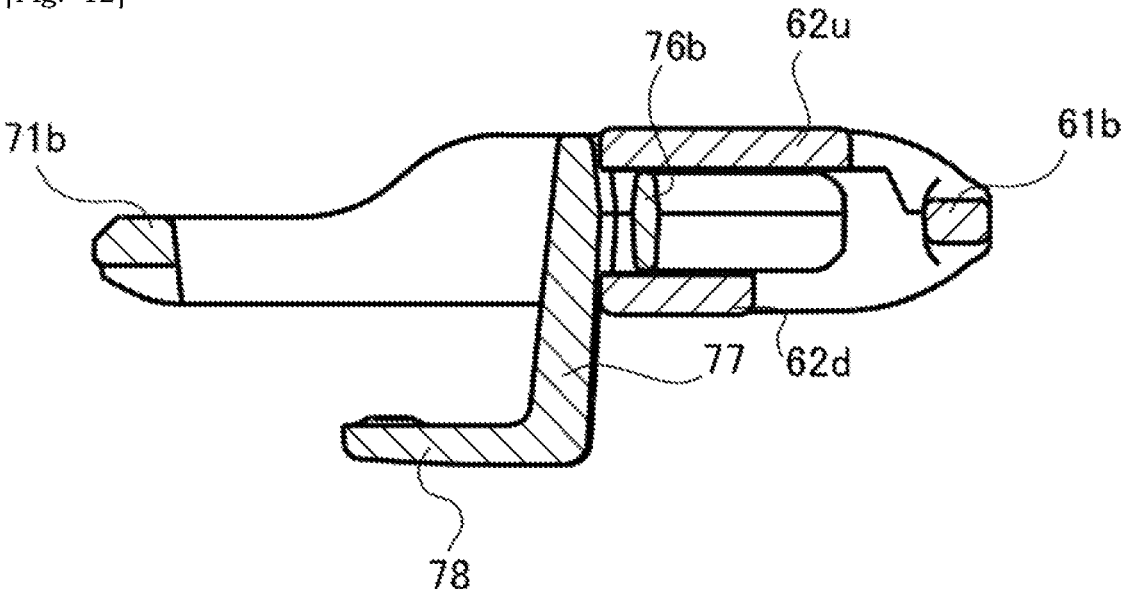

[Fig. 13]
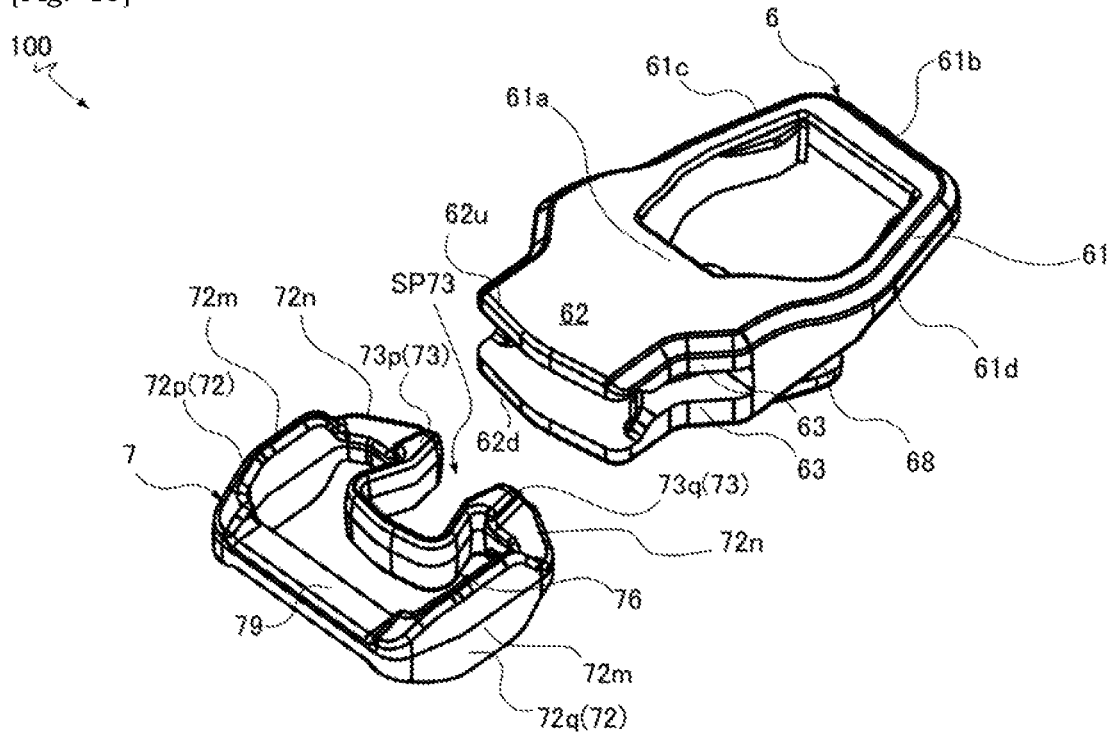
[Fig. 14]
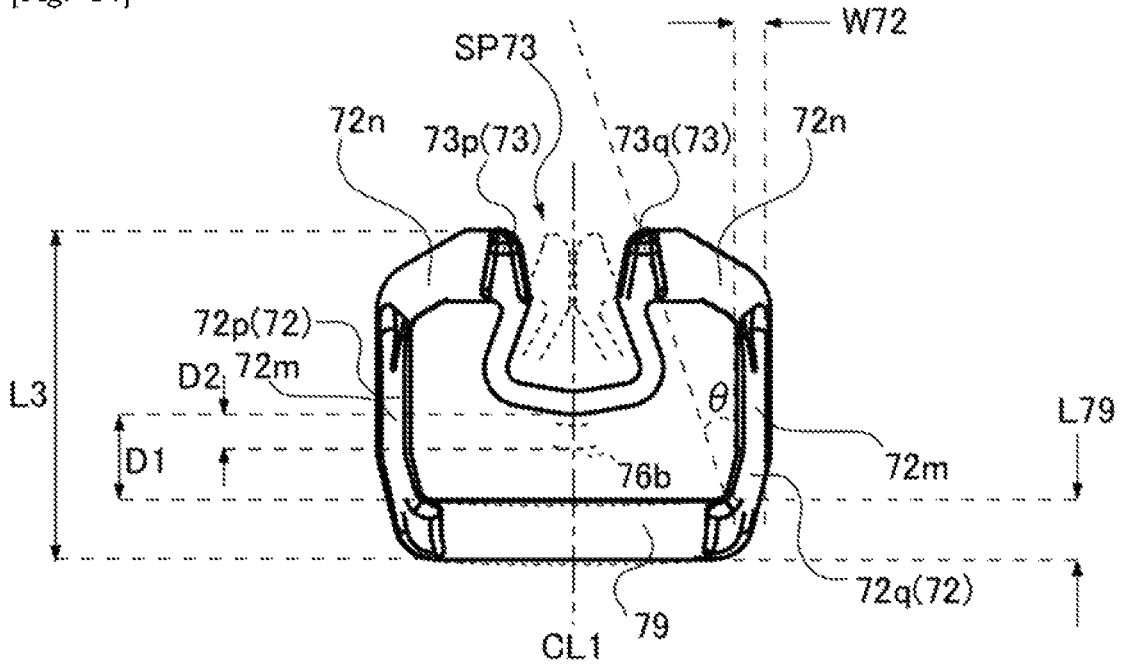

[Fig. 15]
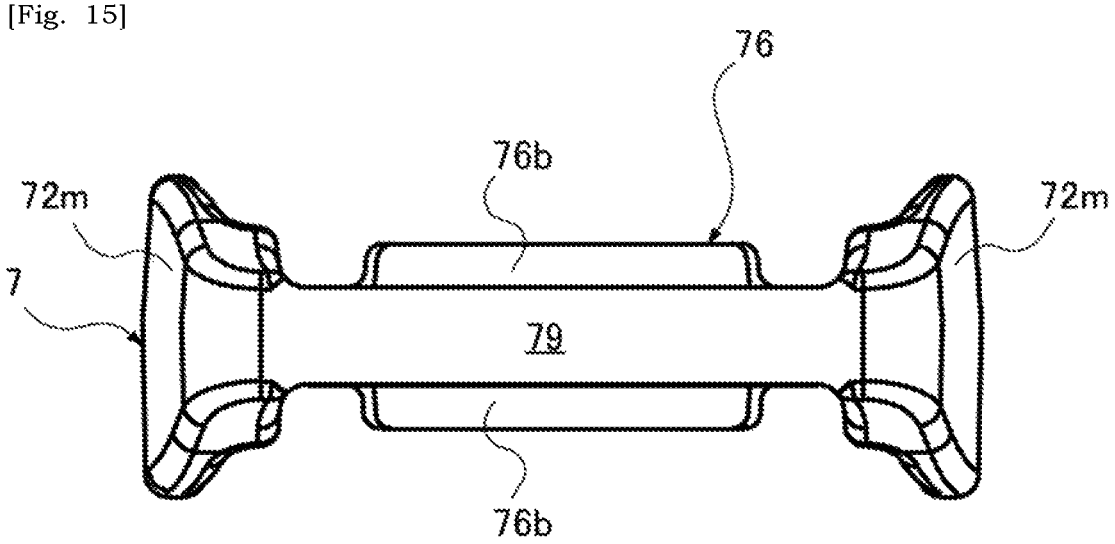
[Fig. 16]
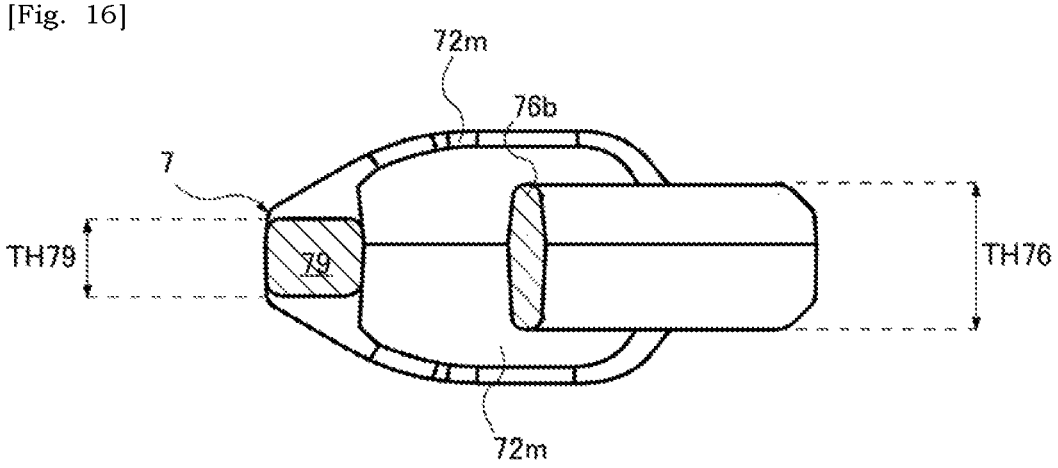

[Fig. 17]
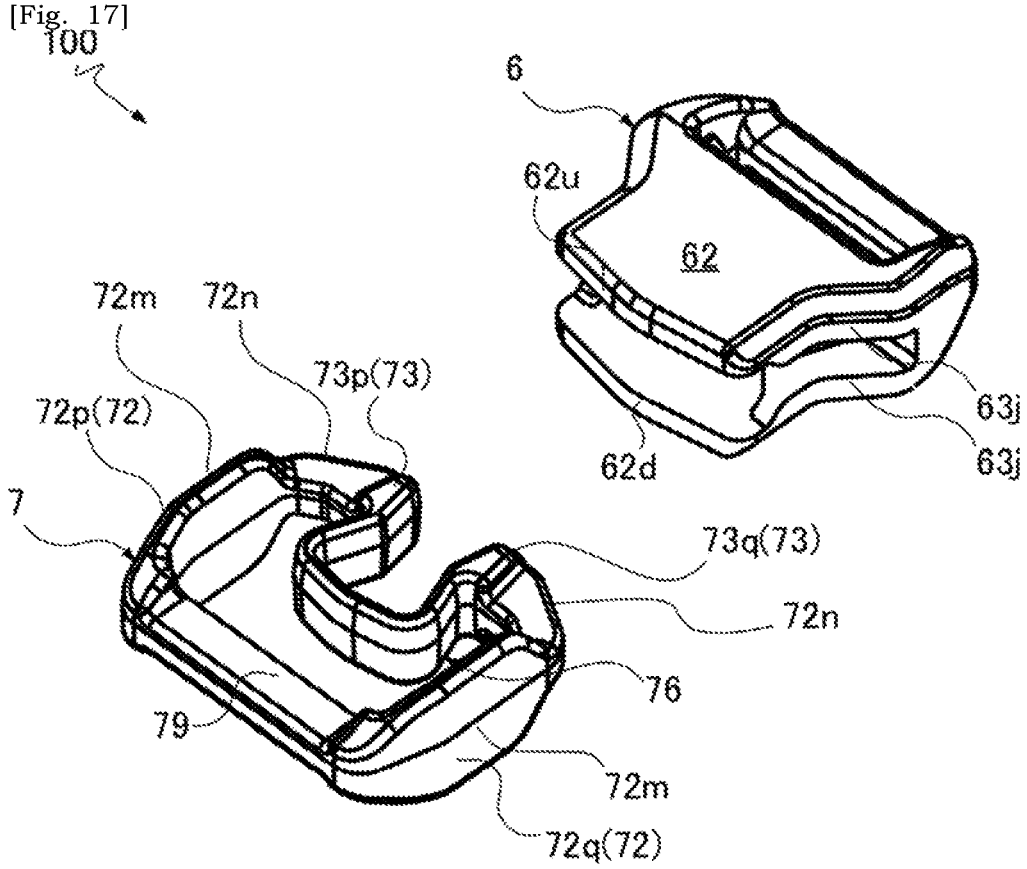
[Fig. 18]
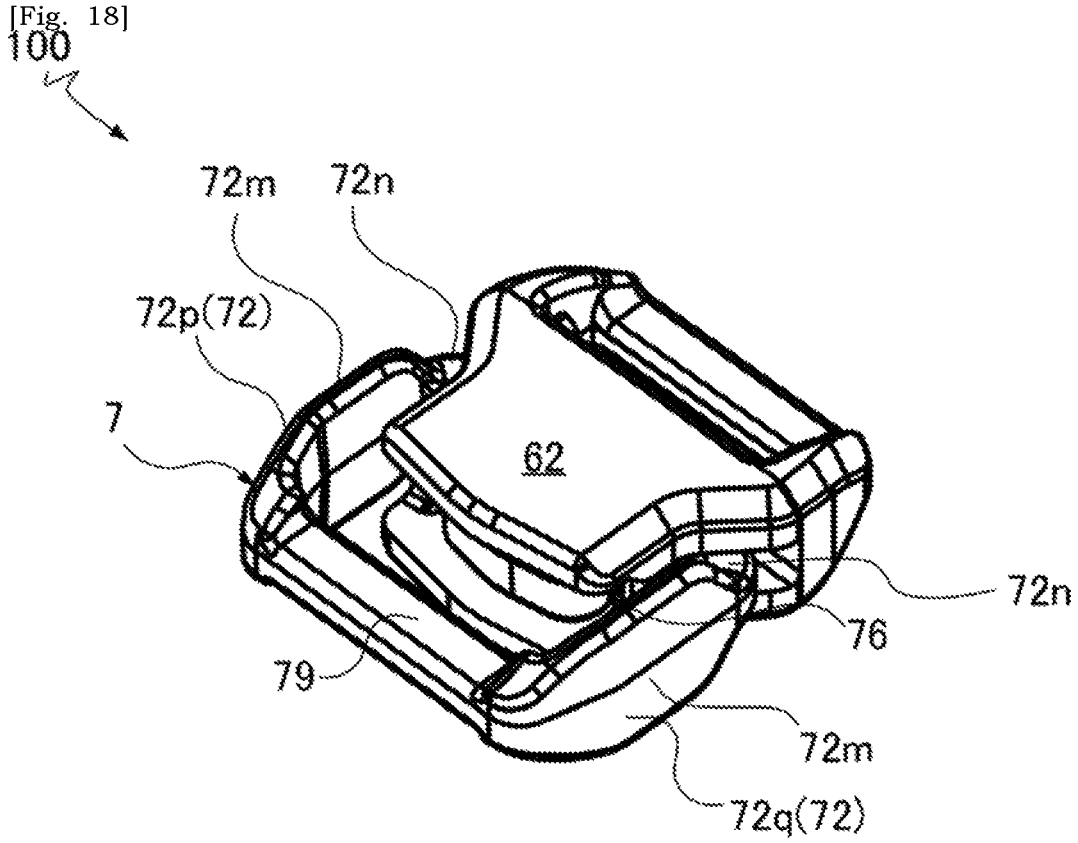

BUCKLE AND BUCKLE MALE PART

CROSS-REFERENCE TO RELATED APPLICATION

The present application claims a priority of Japanese Patent Application No. 2019-155065, filed on Aug. 27, 2019 and entitled "BUCKLE AND BUCKLE MALE PART", the entire content of which is hereby incorporated by reference.

TECHNICAL FIELD

The present disclosure is related to buckles and buckle male parts.

BACKGROUND

In common slide fasteners, one can easily open and close a slide fastener by pulling a pull tab of a slider. This is preferable from an aspect of convenience, but is fragile from an aspect of security. In this regard, European Patent No. 1300093 discloses a technique to integrally allocate a function of buckle male or female part to a slider of a slide fastener. Further, Japanese Patent No. 3034852 discloses that a locking member is coupled to a slider via a cord.

Also, various fastening members have been designed which are attachable to a slider body. For example, Japanese Patent Application Laid-open No. 2007-44535 discloses that a latch is attached to a slider body to enable coupling of sliders (See FIG. 7). Japanese Patent No. 4614140 discloses that a latch is attached to a bottom of a slider body (See FIG. 2). Japanese Patent No. 6035342 discloses a slider cover provided with an accommodating portion for accommodating a slider (See FIG. 1).

Note that Japanese Patent No. 5170889 discloses that, in a buckle having a male part in which an elastic portion is provided with a release-operation portion to be operated by person's fingers, the release-operation portion and an attachment portion for a belt-like-member are overlapped in the coupling direction of the male and female parts of the buckle (See FIG. 1).

SUMMARY

Newly recognized technical challenge is to reduce a length of buckle male part in a coupling direction of buckle male and female parts.

Solution to Problem

A buckle according to an aspect of the present disclosure may include a female part and a male part which are coupled in separable manner, at least one of the female part and the male part being attached to a slider of a slide fastener, wherein in a case (A) where only the female part is attached to a slider of a slide fastener, the male part comprises: a pair of arms respectively provided with locking protrusions; and a connecting rod connecting respective base ends of the pair of arms, wherein the connecting rod is configured to curve away from a space between the locking protrusions of the arms when the arms are bent such that the locking protrusions approach one another; and in a case (B) where the male part is attached to a slider of a slide fastener, the male part comprises: a slider-holding frame configured to hold the slider; and a pair of arms that extend in the same direction from the slider-holding frame and are respectively provided with locking protrusions, wherein the slider-holding frame includes a frame portion protruded into a space between the pair of arms toward a space between the locking protrusions.

In some embodiments, the male part further includes a resin-made spring that interconnects the arms. The resin-made spring may be a belt-like portion that interconnects the locking protrusions of the arms. The resin-made spring may include a pair of sloped belts respectively connected to the locking protrusions and a bottom belt extending to interconnect the sloped belts, and an interspace between the pair of sloped belts may gradually increase toward the bottom belt from said space between the locking protrusions.

In the case of (A), the male part may be configured as a closed loop-like member by a combination of the resin-made spring, the pair of arms, and the connecting rod. The male part may be attached, based on winding of a tape or a belt or a cord about the connecting rod, to an article to which the slide fastener is secured. Each of the arms may include an arm main portion and an arm terminal portion, the arm terminal portion being connected to the connecting rod via the arm main portion and being provided with the locking protrusion. Maximum thickness of the connecting rod may be less than Maximum thickness of the arm terminal portion provided with the locking protrusion. The arm main portion may be a portion to be pushed by a person's finger, the thickness of the arm main portion being the greatest in the male part in the thickness direction of the buckle male part. $0.3<(L79/W72)<2.5$ may be satisfied where L79 indicates a width of the connecting rod in the coupling direction of the female part and the male part, and W72 indicates a width of the arm in the width direction of the male part.

In the case of (B), the slider-holding frame may further include another frame portion that is connected to said frame portion to define an opening. The slider-holding frame may include a support connected to the frame portion a via a hanging portion, the slider being sandwiched between the frame portion a and the support. The support may be shaped to partially match an outer profile of a top wing or a bottom wing of the slider. The male part may further include a resin-made spring interconnecting the arms, and the resin-made spring may touch the slider-holding frame when the arms are bent to approach one another.

A buckle male part according to an aspect of the present disclosure may include: a pair of arms respectively provided with locking protrusions; and a connecting rod connecting respective base ends of the pair of arms, wherein the connecting rod may be configured to curve away from a space between the locking protrusions of the arms when the arms are bent such that the locking protrusions approach one another.

A buckle male part according to an aspect of the present disclosure may include: a slider-holding frame configured to hold a slider of a slide fastener; and a pair of arms that extend in the same direction from the slider-holding frame and are respectively provided with locking protrusions, wherein the slider-holding frame may include a frame portion protruded into a space between the pair of arms toward a space between the locking protrusions.

The buckle male part described above may further include a resin-made spring interconnecting the arms. The resin-made spring may be a belt-like portion that interconnects the locking protrusions of the arms. The resin-made spring may include a pair of sloped belts respectively connected to the locking protrusions and a bottom belt extending to interconnect the sloped belts, and an interspace between the pair of sloped belts may gradually increase toward the bottom belt b from said space between the locking protrusions. $0.3<(L79/W72)<2.5$ may be satisfied where L79 indicates a width of the connecting rod in the coupling direction of the female part and the male part, and W72 indicates a width of the arm in the width direction of the male part.

An aspect of the present disclosure may facilitate reduction of a length of buckle male part in a coupling direction of buckle male and female parts.

BRIEF DESCRIPTION OF DRAWINGS

Hereinafter, non-limiting embodiments and features of the present invention will be described with reference to FIGS. 1 to 18:

FIG. 1 is a schematic top view of a slide fastener to which a buckle for simple locking of a slide fastener according to a first embodiment is attached;

FIG. 2 is a schematic perspective view of a buckle in which buckle male and female parts are coupled;

FIG. 3 is a schematic perspective view of a buckle in which buckle male and female parts are separated;

FIG. 4 is a schematic top view of a buckle, schematically illustrating that locking protrusions of a buckle male part are locked by locking portions of a buckle female part;

FIG. 5 is a front-side view of a buckle female part;

FIG. 6 is a front-side view of a buckle male part;

FIG. 7 is a right-side view of a buckle female part;

FIG. 8 is a right-side view of a buckle male part;

FIG. 9 is an illustration depicting that buckle male part and buckle female part are respectively attached to sliders;

FIG. 10 is a schematic partial view of an article to which a buckle of a second embodiment is attached, the buckle female part be provided with a belt-holding portion as an alternative to a slider-holding frame;

FIG. 11 is a schematic perspective view of a buckle in which buckle male and female parts are coupled;

FIG. 12 is a schematic center-cross-section of a buckle;

FIG. 13 is a schematic perspective view of a buckle of a third embodiment, only buckle female part is attached to a slider, and buckle male part is attached to an article to which a slide fastener is secured;

FIG. 14 is a schematic top view of a buckle male part;

FIG. 15 is a schematic rear-side view of a buckle male part;

FIG. 16 is a schematic center-cross-section of a buckle male part;

FIG. 17 is a schematic perspective view of a buckle of a fourth embodiment in which buckle male and female parts are separated; and FIG. 18 is a schematic perspective view of a buckle in which buckle male and female parts are coupled.

DETAILED DESCRIPTION

A skilled person would be able to combine respective embodiments and/or respective features without requiring excess descriptions, and would appreciate synergistic effects of such combinations. Overlapping descriptions among the embodiments would be basically omitted. Referenced drawings are mainly for describing inventions, and may possibly be simplified for the sake of convenience of illustration. Individual features will be understood as a universal feature which is not only effective to buckles disclosed in the present specification but also effective to buckles not disclosed in the present specification.

Regarding a slide fastener or a buckle attached thereto, Front-Rear direction is understood based on movement of a slider. Front-side matches a direction in which a slider moves to close a slide fastener (to couple fastener stringers). Rear-side matches a direction in which a slider moves to open a slide fastener (to separate fastener stringers). Left-Right direction is orthogonal to Front-Rear direction and is parallel to a tape surface of a fastener tape. UP-Down direction is orthogonal to Front-Rear direction and is orthogonal to a tape surface of a fastener tape. Slide fastener 1 illustrated in FIG. 1 includes two sliders 5*a*,5*b*, and different standards regarding directions will be applied to the respective sliders 5*a*,5*b*. Front-side of the slider 5*a* is opposite to front-side of the slider 5*b*. Regarding double-headed-arrows in FIG. 1, F indicates a front-side, Re indicates a rear-side, L indicates a left-side, and Ri indicates a right-side.

Structures of a buckle can be described with reference to directions based on a buckle without referring to the above-defined slider-based directions. As would be appreciated from the following descriptions, embodiments are envisioned in which not only a buckle is used together with a slide fastener but also a buckle is independently used without a slide fastener. In particular, a reference may be made to a coupling direction of female and male parts in a buckle. The coupling direction matches a direction a female part and/or a male part are/is moved for coupling the female and male parts (Note that, the coupling direction is parallel to the above-described front-rear direction based on a slider). Width direction and Thickness direction orthogonal to Coupling direction will be referred. Width direction is a direction in which a pair of arms are apposed. Thickness direction is orthogonal to Coupling direction and Width direction.

THE 1$^{ST}$ EMBODIMENT

First embodiment will be described with reference to FIGS. 1 to 9. Slide fastener 1 is attached to a container such as a bag for example and enables opening and closing of the container. Slide fastener 1 has a pair of left and right fastener stringers 2 and two sliders 5*a*,5*b* (totally 5) for opening and closing the slide fastener 1 (for coupling and separating the stringers). The number of slider included in the slide fastener 1 should not be limited to 2, and embodiments are envisioned where one or three or three or more sliders are included. Each fastener stringer 2 has a fastener tape 3 the thickness of which is defined by upper and lower tape surfaces, and a fastener element 4 attached to a side-edge of the fastener tape 3.

The fastener tape 3 is a woven fabric or knitted fabric or combination thereof with sufficient flexibility. The fastener element 4 is a metal element or a resin element or a coil element in which monofilament is helically wound. Attachment of the fastener element 4 to the fastener tape 3 will be appropriately done in accordance with a type of element. In cases of metal elements, the elements are swaged and attached to the side-edge of the fastener tape 3. In cases of resin elements, the elements are attached to the fastener tape 3 through insert-molding. In cases of coil element, the coil element is sewn to the fastener tape 3. The slider 5 may be made of resin, metal or ceramics.

The slider 5 has a top wing 51, a bottom wing 52, a coupling pillar 53 for coupling these wings, a pull-attachment column 54 and flanges 55 (See FIGS. 1 and 9). Illustration of a pull tab attached to the pull-attachment column 54 is omitted. The top wing 51 and the bottom wing 52 are opposed, and a passage for the fastener elements 4 is defined in the up-down direction. Left and right flanges 55 are opposed, and the passage for the fastener elements 4 is restricted in the left-right direction. The coupling pillar 53 is provided in the center of the left-right direction at the front end of the top wing 51. A pair of left and right front mouths are arranged to sandwich the coupling pillar 53, and the respective left and right fastener elements 4 move into and out from the slider 5 there-through. One rear mouth is provided at the opposite side of the left and right mouths, and the (engaged) left and right fastener elements 4 moves into and out from the slider 5 there-through.

Buckle for simple/temporal locking of a slide fastener (hereinafter simply referred to as a buckle) 100 is used to arrest the respective sliders 5*a*,5*b* of the slide fastener 1. The buckle 100 includes a female part 6 and a male part 7 which are coupled in separable manner. Each of the female part 6 and the male part 7 is attached to the slider 5*a*,5*b*. As long as the female part 6 and the male part 7 are coupled, the slider 5*a*,5*b* cannot move individually and freely. Separating the left and right fastener stringers 2 is hindered, thus enhancing the security of an article to which the slide fastener 1 is secured. Note that, the buckle 100 of the present disclosure can be used not only to keep the slide fastener 1 closed but also to keep the slide fastener 1 open. Furthermore, embodiments are envisioned where one or both of the male and female parts 7 and 6 are not attached to the slider 5 of the slide fastener 1.

Hereinafter, a configuration of the buckle 100 will be described in detail. Each of the female part 6 and the male part 7 can be made of resin (e.g. Polyacetal, Nylon, Polypropylene, Elastomer, and Polycarbonate) and can be produced through injection-molding. The male part 7 has a slider-holding frame 71 configured to hold the slider 5, a pair of arm 72*p*,72*q* (totally 72) that extend in the same direction from the slider-holding frame 71 and are respectively provided with locking protrusion 73*p*,73*q* (totally 73), and a resin-made spring 76 that interconnects the arms 72. The female part 6 has a slider-holding frame 61 and an arm-receiving portion 62 that is connected to the slider-holding frame 61. The locking protrusion 73 is a portion to be locked by a locking portion 63 of the female part 6 when the male part 7 and female part 6 are fully coupled.

The slider-holding frame 71 of the male part 7 has a frame body 71*f* configured to hold the top wing 51 or the bottom wing 52 of the slider 5, and a support 78 connected to the frame body 71*f* via a hanging portion 77. In common sliders, a pull-attachment column is arranged onto the top surface of the top wing, making the top surface of the top wing uneven. In common sliders, the bottom surface of the bottom wing is a flat surface. Therefore, in cases where the slider-holding frame 71 is provided with the support 78, the frame body 71*f* is typically configured to hold the top wing of the slider. However, the frame body 71*f* can be configured to hold the bottom wing 52 of the slider 5.

The frame body 71*f* is sectioned into a frame portion (first frame portion) 71*a* and a frame portion (second frame portion) 71*b* in the coupling direction of the female part 6 and the male part 7. The frame portion 71*b* is connected to the frame portion 71*a* to define an opening. Base end 72*r* of the arm 72 is connected to a portion at which the frame portion 71*a* and the frame portion 71*b* are connected. The frame portion 71*a* extends in C-shape or U-shape between the base end 72*r* of one arm 72 and the base end 72*r* of the other arm 72. Similarly, the frame portion 71*b* extends in C-shape or U-shape between the base end 72*r* of one arm 72 and the base end 72*r* of the other arm 72. In the coupling direction of the female part 6 and the male part 7, the length L1 of the frame portion 71*a* is less than the length L2 of the frame portion 71*b* (See FIG. 4). Interference between the arm 72 and the frame portion 71*a* when the arm 72 pivots may be suppressed by shortening the range, in which the arm 72 and the frame portion 71*a* are overlapped, in the coupling direction of the female part 6 and the male part 7.

In the present embodiment, the frame portion 71*a* protrudes into a space between the arms 72*p*,72*q* toward the space SP73 between the locking protrusions 73*p*,73*q*. This allows reduction of the length L0 (See FIG. 4) of the male part 7 in the coupling direction of the female part 6 and the male part 7. Slits SL1,SL2 are formed between the arm 72 and the frame portion 71*a*, thus avoiding the interference between the arm 72 and the frame portion 71*a*.

The frame body 71*f* has a pair of side portions 71*c*,71*d* to which the base end 72*r* of the arm 72 is connected, a wall 71*j* that extends in the width direction of the male part 7 to interconnect ends of the side portions 71*c*,71*d*, and a bar 71*k* that extends in the width direction of the male part 7 to interconnects the other ends of the side portions 71*c*,71*d*. The side portions 71*c*,71*d* extend along the left-side and right-side edges of the slider 5 to be adapted for holding the slider 5. Interspace between the side portions 71*c*,71*d* in the width direction of the male part 7 gradually increases and then gradually decreases as the side portions 71*c*,71*d* extend away from the wall 71*j*. The point of this transition of the interspace may correspond to the front end of the flange 55 of the slider 5.

Bulged portion 71*z* may be provided which reduces a width of the opening of the slider-holding frame 71 (the frame body 71*f*) in the width direction of the male part 7. This allows that the top wing 51 or the bottom wing 52 of the slider 5 is securely held by the slider-holding frame 71 (the frame body 71*f*). Note that the frame body 71*f* is not necessarily a closed frame. The frame body 71*f* may be a frame with a partial cutout. For example, the bar 71*k* is omitted and the frame body 71*f* is U-shaped.

Slider 5 is held between the frame body 71*f* and the support 78. The support 78 is shaped to partially match an outer profile of the top wing 51 or the bottom wing 52 of the slider 5, thus the support 78 can have no projection from the slider 5. Typically, the support 78 is shaped to match the front-half of the outer profile of the top wing 51 or the bottom wing 52. The support 78 may be arranged inwardly of the inner edge of the slider-holding frame 71 (See FIG. 3). In this case, the slider-holding frame 71 and the support 78 are not overlapped in the thickness direction of the male part 7. One or more bosses 78*p* configured to contact the slider 5 (e.g. the bottom surface of the bottom wing 52) can be provided onto the support 78. Preferably, the boss 78*p* is arranged closer to the free end of the support 78 which is opposite to the connecting end of the support 78 with the hanging portion 77. This allows that the slider 5 is more securely held between the frame body 71*f* and the support 78.

Attachment of the male part 7 to the slider 5 is possible as schematically shown in FIG. 9 by pushing the slider 5 into a space between the bar 71*k* and the support 78 which is accompanied by increase and decrease of distance between the bar 71*k* and the support 78. It is adequate that at least one of the bar 71*k* and the support 78 is displaced. In some cases, the support 78 pivots about a connecting end of the hanging portion 77 connected to the wall 71*j*. Embodiments are envisioned where the hanging portion 77 and the support 78 may be omitted and the slider 5 is held by the frame body 71*f* only.

The arm 72*p*,72*q* has a base end 72*r* connected to the boundary between the frame portion 71*a* and the frame portion 71*b*, and the arm 72*p*,72*q* extend in the same direction from the base ends 72*r* away from the slider-holding frame 71 in the coupling direction of the female part 6 and the male part 7. The arm 72*p*,72*q* can be bent about its base end 72*r* inwardly in the width direction, allowing the locking protrusions 73 of the arms 72*p*,72*q* to approach one another. Note that, inner-side in the width direction is a direction directed to a center line CL1 (See FIG. 4) regarding the width direction of the male part 7. Outer-side in the width direction is a direction directed away from the center line CL1 (See FIG. 4) regarding the width direction of the male part 7. The arm 72 can be bent inward in the width direction in accordance with external force and, when the external force is released, can move outward in the width direction back to the initial posture. When viewed from above as shown in FIG. 4, the left arm 72*p* can pivot clockwise to the right side about its base end 72*r*. The right arm 72*q* can pivot counterclockwise to the left side about its base end 72*r*.

The arm 72*p*,72*q* has an arm main portion 72*m* extending in the coupling direction of the female part 6 and the male part 7, and an arm terminal portion 72*n* connected to the slider-holding frame 71 via the arm main portion 72*m* and provided with the locking protrusion 73. The arm main portion 72*m* linearly extends away from the slider-holding frame 71 in the coupling direction of the female part 6 and the male part 7. The arm terminal portion 72*n* extends in an arc inward in the width direction toward the other arm 72 (e.g. its locking protrusion 73) of the pair. The locking protrusion 73 is provided at the inner end of the arm terminal portion 72*n*, but its location should not be limited to this. In cases where the locking protrusions 73 are arranged adjacently (apposed) with a predetermined space SP73, it is facilitated that the width of the arm-receiving portion 62 of the female part 6 is reduced (See FIG. 5). The locking protrusion 73 protrudes from the arm terminal portion 72*n* in the opposite directions (i.e. upward and downward) in the thickness direction of the male part 7 (See FIG. 6). Note that, embodiments are envisioned where the locking protrusion 73 protrudes only one side in the UP-Down direction.

The arm main portion 72*m* is pushed by a person's finger to operate the posture of the arm 72. The arm main portion 72*m* is pushed inward in the width direction so that the arm 72 is bent inward in the width direction and the locking protrusion 73 of the arm terminal portion 72*n* moves inward in the width direction. The arm main portion 72*m* is a flat belt-like portion having a small width in the width direction of the male part 7 and having a greater thickness in the thickness direction of the male part 7 (compared with the width). In other words, the arm main portion 72*m* has a thin thickness in the width direction of the male part 7 and a wide width in the thickness direction of the male part 7. In cases where the thickness of the arm main portion 72*m* in the thickness direction of the male part 7 is the maximum in the male part 7, it is possible to provide a widen contact area for a person's finger. Note that, in the thickness direction of the male part 7, the thickness of the arm main portion 72*m* is greater than the thicknesses of the arm terminal portion 72*n* and the locking protrusion 73.

Slits SL1,SL2 are formed between the arm main portion 72*m* and the frame portion 71*a*, allowing the arm 72 to be bent about the base end 72*r* inward in the width direction. The slits SL1,SL2 extend along the coupling direction of the female part 6 and the male part 7 with a substantially constant lateral width. Space allowing the resin-made spring 76 to be arranged therein is formed between the arm terminal portion 72*n* and the frame portion 71*a*.

In the arms 72*p*,72*q*, when the arm 72 is not deformed, $0° < \theta < 80°$ is satisfied where θ indicates an angle between an axial line AX1 matching the extending direction of the arm main portion 72*m* and an axial line AX2 extending between the base end 72*r* of the arm 72 and the locking protrusion 73. The locking protrusions 73 are arranged adjacently with a given space SP73, facilitating that the width of the arm-receiving portion 62 of the female part 6 is reduced.

Width of the space SP73 between the locking protrusions 73*p*,73*q* is variable. When the arm main portions 72*m* are pushed inward in the width direction such that the locking protrusions 73 approach one another for the male part 7 to be coupled to or decoupled from the female part 6, the width of the space SP73 in the width direction of the male part 7 is reduced. In cases where the resin-made spring 76 is provided, the resin-made spring 76 and the slider-holding frame 71 touch one another and the width of the space SP73 may be hindered to be smaller. However, the width of the space SP73 may be further smaller if the resin-made spring 76 deforms. Note that, if the resin-made spring 76 and the slider-holding frame 71 contact one another, the arm 72 may be prevented from being bent excessively. It is not a requisite that the resin-made spring 76 touches the slider-holding frame 71 in a process of coupling of the female part 6 and the male part 7.

The resin-made spring 76 may be a belt-like portion that interconnects the respective locking protrusions 73 of the arms 72. A closed loop is formed by the combination of the resin-made spring 76, the arm 72*p*,72*q*, and the slider-holding frame 71, improving the mechanical strength of the male part 7. For example, in cases where the resin-made spring 76 is not provided, there may be a possibility that a foreign body enters a space between the arms 72*p*,72*q* to destroy the arms 72. Such a problem may be avoided or suppressed in cases where the arms 72*p*,72*q* are connected by the resin-made spring 76.

The resin-made spring 76 has a pair of sloped belts 76*p*,76*q* which are respectively coupled to the locking protrusions 73 of the arms 72 and a bottom belt 76*b* that extends to interconnect the sloped belts 76*p*,76*q*. Distance between the pair of sloped belts 76*p*,76*q* gradually increases toward the bottom belt 76*b* from the space SP73 between the locking protrusions 73*p*,73*q*. In some cases, when the arms 72 are bent such that the locking protrusions 73 approach one another for the male part 7 to be coupled to or decoupled from the female part 6, the resin-made spring 76 and the slider-holding frame 71 are brought into contact one another. This is a result of reduced length of the male part 7 in the coupling direction of the female part 6 and the male part 7.

The resin-made spring 76 (e.g. the bottom belt 76*b*) and the frame portion 71*a* have complementary opposed surfaces f1, f2 (See FIG. 4). The opposed surface f1 has a pair of sloped surfaces which are arranged adjacently to shape a protrusion on the center line CL1 of the male part 7. The opposed surface f2 has a pair of sloped surfaces which are arranged adjacently to shape a recess on the center line CL1 of the male part 7. This allows that a movable range for the resin-made spring 76, in turn for the locking protrusions 73 is widened. Additionally or alternatively, this allows that a force is set within an appropriate range which is required for coupling the male part 7 and the female part 6. Note that, in some cases, deformation of the resin-made spring 76 allows the locking protrusions 73 of the arms 72 to be in contact one another.

Position and direction of protruding of the locking protrusion 73 of the arm 72 would be various and should not be limited to the illustrated examples. The locking protrusion 73 may protrude not in the thickness direction of the male part 7, but in the width direction of the male part 7. For example, a left locking protrusion 73 may be arranged to protrude leftward from the left-side surface of the left arm 72*p*. Right locking protrusion 73 may be arranged to protrude rightward from the right-side surface of the right arm 72*q*. In such cases, a resin portion of the male part 7 may be arranged in the space SP73 between the locking protrusions 73*p*,73*q* but there is still a space SP73 between the locking protrusions 73.

As described above, the female part 6 has a slider-holding frame 61 and an arm-receiving portion 62 connected to the slider-holding frame 61. Likewise the slider-holding frame 71 of the male part 7, the slider-holding frame 61 has a frame body 61*f* configured to hold the top wing 51 or the bottom wing 52 of the slider 5, and a support 68 connected to the frame body 61*f* via a hanging portion 67 The frame body 61*f* has a pair of side portions 61*c*,61*d*, a wall 61*j* extending in the width direction of the female part 6 to interconnect one ends of the side portions 61*c*,61*d*, and a bar 61*k* extending in the width direction of the female part 6 to interconnect the other ends of the side portions 61*c*,61*d*.

The side portions 61*c*,61*d* extend along the left-side and right-side edges of the slider 5 so as to be adapted for holding the slider 5. Interspace between the side portions 61*c*,61*d* in the width direction of the female part 6 gradually increase and then gradually decrease as the side portions 61*c*,61*d* extending away from the wall 61*j*. The point of this transition of the interspace may correspond to the front end of the flange 55 of the slider 5. Note that, the frame body 61*f* is not necessarily limited to a closed frame. The frame body 61*f* may be a frame with partial cutout. For example, the bar 61*k* is omitted, and the frame body 61*f* is U-shaped.

Likewise the male part 7, the slider 5 is sandwiched and held between the frame body 61*f* and the support 68 in the female part 6. Description made for the frame body 71*f* and the support 78 of the male part 7 holds true for the frame body 61*f* and the support 68 of the female part 6 and thus overlapping descriptions are omitted. Note that, in the slide fastener 1, the supports 78,68 of the male part 7 and the female part 6 extend in the opposite directions, respectively, from the hanging portions 77,67 of the male part 7 and the female part 6 (See FIGS. 7-9).

The arm-receiving portion 62 has a pair of plates i.e. top plate and bottom plate 62*u*,62*d* which are arranged to face one another in the thickness direction of the female part 6. The top and bottom plates 62*u*,62*d* extend substantially in parallel in the same direction (along the coupling direction of the female part 6 and the male part 7) from the wall 61*j* of the slider-holding frame 61. Receiving space 62*m* for receiving the arms 72 is formed by the top and bottom plates 62*u*,62*d*. The receiving space 62*m* has a main opening 62*m*1 between ends of the top and bottom plates 62*u*,62*d*, and left-side and right-side openings 52*m*2 between edges (at the same side) of the top and bottom plates 62*u*,62*d* (See FIG. 3).

The opposed surfaces of the top and bottom plates 62*u*, 62*d* are respectively provided with a pair of locking portions 63*p*,63*q* (totally 63) (See FIGS. 4 and 5). The locking portions 63*p*,63*q* are arranged with an interspace in the width direction of the female part 6. Each locking portion 63*p*,63*q* has a guide surface 63*a*, and a locking surface 63*b* positioned farther away from the main opening 62*m*1 than the guide surface 63*a*, and an intermediate surface 63*c* between the guide surface 63*a* and the locking surface 63*b*. The guide surfaces 63*a* of the locking portions 63*p*,63*q* approach one another as being away from the main opening 62*m*1 (e.g. toward the wall 61*j* of the slider-holding frame 61).

When the male part 7 is moved toward the female part 6 to be coupled with the female part 6, the locking protrusions 73 of the arms 72 touch the guide surfaces 63*a* of the locking portions 63. When the locking protrusion 73 moves on the guide surface 63*a* away from the main opening 62*m*1 of the arm-receiving portion 62, the locking protrusion 73 is gradually displaced inward in the width direction toward the center line CL1 of the male part 7. Accordingly, the space SP73 between the locking protrusions 73*p*,73*q* is reduced. After the locking protrusion 73 passes the guide surface 63*a* and passes the intermediate surface 63*c*, the locking protrusion 73 can move outward in the width direction of the buckle 100. The space SP73 between the locking protrusions 73 in the width direction of the buckle 100 increases, and the locking protrusion 73 and the locking surface 63*b* are brought into contact and/or face one another. Even when the male part 7 is moved away from the female part 6, the male part 7 cannot be separated from the female part 6 as the locking protrusion 73 is in contact with the locking surface 63*b* of the locking portion 63.

THE 2ND EMBODIMENT

Second embodiment will be described with reference to FIGS. 10 to 12. As would be understood from FIG. 10, only the male part 7 is attached to the slider 5 of the slide fastener 1. The female part 6 is not attached to a slider of the slide fastener 1, but is attached, via a tape or a belt or a cord, to an article P1 to which the slide fastener 1 is secured. Likewise the first embodiment, in the present embodiment, the frame portion 71*a* protrudes into a space between the pair of arms 72*p*,72*q* toward the space SP73 between the locking protrusions 73*p*,73*q* in the male part 7. This allows reduction of a length of the male part 7 in the coupling direction of the female part 6 and the male part 7.

As would be understood from FIGS. 11 and 12, the structure of the male part 7 is the same as that described in the first embodiment. The female part 6 has an attachment portion 65 for a belt or a tape, as an alternative of the slider-holding frame 61. The attachment portion 65 has a beam 65*m*, and a pair of left and right supports 65*p*,65*q* which supports the respective ends of the beam 65*m*. The top plate 62*u* and the bottom plate 62*d* are connected to the supports 65*p*,65*q*.

THE 3RD EMBODIMENT

Third embodiment will be described with reference to FIGS. 13 to 16. As would be understood from FIG. 13, only the female part 6 is attached to the slider 5 of the slide fastener 1. The male part 7 is not attached to a slider of the slide fastener 1, but is attached, via a tape or a belt or a cord, to an article P1 to which the slide fastener 1 is secured. Likewise the above-described embodiments, in the present embodiment, the length of the male part 7 in the coupling direction of the female part 6 and the male part 7 can be reduced. Hereinafter, descriptions will be made for this feature.

The male part 7 has a pair of arms 72 which are respectively provided with the locking protrusions 73, and a connecting rod 79 connecting the respective base ends 72*r* of the pair of arms 72. When the arms 72 are bent such that the locking protrusions 73 approach one another for the male part 7 to be coupled to or decoupled from the female part 6, the connecting rod 79 (e.g. the center of the connecting rod 79 between the base ends 72*r* of the pair of arms 72) is configured to curve away from the space SP73 between the locking protrusions 73*p*,73*q* of the arm 72 (See dotted line in FIG. 14). Accordingly, the length L3 (See FIG. 14) of the male part 7 in the coupling direction of the female part 6 and the male part 7 is reduced. Sufficient amount of displacement of the locking protrusions 73 is obtainable while reducing the length L3 of the arm 72 in the coupling direction of the female part 6 and the male part 7. Note that, the center of the connecting rod 79 between the base ends 72*r* of the pair of arms 72 is located on the center line Cl1. The configurations of the arm 72 and the resin-made spring 76 are as described in the first embodiment, and thus the same effect as described in the first embodiment will be achieved.

Distance D2 (See FIG. 14) of movement of the bottom belt of the resin-made spring 76 displacing toward the connecting rod 79 in the center line CL1 when the arms 72 are bent to approach one another is equal to or less than ⅔ or ½ of distance D1 (See FIG. 14) between the connecting rod 79 and the bottom belt of the resin-made spring 76 in the center line CL1 when the arms 72 are not bent to approach one another, allowing the male part 7 to be smaller.

In some cases, 0.3<(L79/W72)<2.5 is satisfied where L79 indicates a width of the connecting rod 79 in the coupling direction of the female part 6 and the male part 7 and W72 indicates a width of the arm 72 in the width direction of the male part 7. Accordingly, bending of the arm 72 and curving of the connecting rod 79 away from the space SP73 may be well balanced. The width L79 of the connecting rod 79 when the connecting rod 79 is not deformed is substantially constant in some cases, but should not be limited to this and maximum value or minimum value or average can be referred. Width W72 of the arm 72 may be a width of the arm main portion 72*m*. Width W72 of the arm main portion 72*m* is substantially constant in the coupling direction of the female part 6 and the male part 7, but should not be limited to this and maximum value or minimum value or average can be used.

In some cases, Width W72 of the arm 72 is 0.9 to 1.7 mm and/or Width L79 of the connecting rod 79 in the coupling direction of the female part 6 and the male part 7 is 1.5 to 2.8 mm. This facilitates the arm 72 to bend and/or the connecting rod 79 to curve away from the space SP73.

In some cases, the cross-sectional area of the connecting rod 79 in the center line CL1 of the width direction of the male part 7 is 1.1 to 1.7 $mm^2$. The connecting rod 79 may extend between the arms 72*p*,72*q* while maintaining a cross-sectional area which is constant or in the above range. The connecting rod 79 may have a cross-sectional shape such as a rectangle or oval. In some cases, the maximum of radius of curvature of the connecting rod 79 caused by deformation of the connecting rod 79 is 200 mm to 300 mm, preferably 104 mm to 134 mm. The amount of bending of the connecting rod 79 is less than the amount of bending of the bottom belt of the resin-made spring 76.

The arm 72*p*,72*q* has an arm main portion 72*m* extending in the coupling direction of the female part 6 and the male part 7, and an arm terminal portion 72*n* connected to the connecting rod 79 via the arm main portion 72*m* and provided with the locking protrusion 73*p*,73*q*. The arm main portion 72*m* is connected to an end of the connecting rod 79, and the arm terminal portion 72*n* is connected to the end of the connecting rod 79 via the arm main portion 72*m*. The arm main portion 72*m* extends along the coupling direction away from the connecting rod 79. The arm terminal portion 72*n* extends inward in the width direction toward the other arm 72 (e.g. its locking protrusion 73) of the pair. The locking protrusion 73 is arranged at the inner end of the arm terminal portion 72*n*, but should not be limited to this position. In cases where the locking protrusions 73 are adjacently arranged with a predetermined space SP73, it is facilitated that the width of the arm-receiving portion 62 of the female part 6 is reduced.

The arm main portion 72*m* is pushed by a person's finger to operate the posture of the arm 72. The arm main portion 72*m* is pushed inward in the width direction so that the arm 72 is bent inward in the width direction and the locking protrusion 73 of the arm 72 moves inward in the width direction. The arm main portion 72*m* is a flat plate that is thin in the width direction of the male part 7 and has a wide width/thickness in the thickness direction of the male part 7. In cases where the thickness of the arm main portion 72*m* in the thickness direction of the male part 7 is the greatest in the male part 7, it is possible to provide a widened contact area for a person's finger.

In the arms 72*p*,72*q*, when the arm 72 is not deformed, 0°<θ<80° is satisfied where θ indicates an angle between an axial line AX1 matching the extending direction of the arm main portion 72*m* and an axial line AX2 extending between the base end 72*r* of the arm 72 and the locking protrusion 73. The locking protrusions 73 are arranged adjacently with a given space SP73, and this allows reduction of a width of the arm-receiving portion 62 of the female part 6.

Space SP73 is provided between the locking protrusions 73 of the arms 72*p*,72*q*. Width of the space SP73 in the width direction of the male part 7 is variable. When the arm main portions 72*m* are pushed inward in the width direction such that the locking protrusions 73 approach one another for the male part 7 to be coupled to or decoupled from the female part 6, a width of the space SP73 in the width direction of the male part 7 is reduced. Note that, in the present embodiment, a sufficient interspace is provided between the resin-made spring 76 and the connecting rod 79 such that they do not touch one another.

Preferably, the male part 7 is configured as a closed loop-like member by the combination of the resin-made spring 76, the pair of arms 72*p*,72*q*, and the connecting rod 79. The male part 7 is attached to an article based on winding of a tape or a belt or a cord about the connecting rod 79. As the male part 7 is a loop-like member, it is suppressed that the male part 7 comes off from the tape or belt or cord.

Preferably, the maximum thickness of the connecting rod 79 is less than the maximum thickness of the arm terminal portion 72*n* at which the locking protrusion 73 is provided or the maximum thickness of the resin-made spring 76 (See FIGS. 15 and 16). This ensures a sufficient flexibility of the connecting rod 79. The maximum thickness may be measured in a direction orthogonal to the width direction of the male part 7 (e.g. the thickness direction of the male part 7). Unless clearly expressed, the direction orthogonal to the width direction of the male part 7 should not be limited to a direction orthogonal to the coupling direction and the width direction.

In some cases, regarding the maximum thickness TH79 of the connecting rod 79 and the maximum thickness TH76 of the resin-made spring 76, 0.5<(TH79/TH76)<2.0, preferably 0.5<(TH79/TH76)<1.0, is satisfied. In some cases, the maximum thickness TH76 of the resin-made spring 76 is equal to the maximum thickness of the locking protrusion 73. The maximum thickness TH79 of the connecting rod 79 may be in a range of 1 mm to 5.9 mm.

THE 4$^{TH}$ EMBODIMENT

Finally, Fourth embodiment will be described with reference to FIGS. 17 and 18. As illustrated in FIGS. 17 and FIG.

18, the buckle 100 is not attached to a slide fastener 1 and is used as a single part of buckle. The male part 7 is the same as that described in the third embodiment. The female part 6 is the same as that described in the second embodiment. Likewise the third embodiment, in the present embodiment, when the arms 72 are bent such that the locking protrusions 73 approach one another for the male part 7 to be coupled to or decoupled from the female part 6, the connecting rod 79 (e.g. the center of the connecting rod 79 between the base ends 72*r* of the pair of arms 72) is configured to curve away from the space SP73 between the locking protrusions 73*p*, 73*q*. Accordingly, the length of the male part 7 in the coupling direction of the female part 6 and the male part 7 is reduced. Sufficient amount of displacement of the locking protrusions 73 is obtainable while reducing the length of the arm 72 in the coupling direction of the female part 6 and the male part 7.

In some cases, the maximum length of the buckle 100 in which the female part 6 and the male part 7 are coupled is equal to or less than 15 mm. Reduced length of the male part effectively allows reduction of size of the male part, in turn, of the buckle. Additionally or alternatively, the maximum width of the buckle 100 in which the female part 6 and the male part 7 are coupled is equal to or less than 15 mm. Maximum thickness of the buckle 100 can be freely set, e.g. is equal to or less than 6 mm.

Based on the above teachings, a skilled person in the art would be able to add various modifications to the respective embodiments. Reference numbers in Claims are just for reference and should not be referred for a purpose of narrowly construing the scope of claims.

What is claimed is:

1. A buckle male part comprising:

a slider-holding frame holding a slider of a slide fastener, the slider being separate from the slider-holding frame;

a first buckle arm having a first base end and a first terminal end and extending between the first base end and the first terminal end, the first base end connected to a first portion of the slider-holding frame;

a first buckle locking protrusion formed at the first terminal end of the first buckle arm;

a second buckle arm having a second base end and a second terminal end and extending between the second base end and the second terminal end, the second buckle arm extending away from the slider-holding frame in a same direction as the first buckle arm, the second base end connected to a second portion of the slider-holding frame; and a second buckle locking protrusion formed at the second terminal end of the second buckle arm, wherein the slider-holding frame includes a frame portion extending between the first and second portions of the slider-holding frame, the frame portion protruded outwardly of the slider held by the slider-holding frame into a first space between the first and second buckle arms toward a second space between the first and second buckle locking protrusions, the first space including a first slit defined between the frame portion and the first buckle arm, and a second slit defined between the frame portion and the second buckle arm, the first slit allowing the first buckle arm to be bent toward the frame portion and the second slit allowing the second buckle arm to be bent toward the frame portion.

2. The buckle male part of claim 1, wherein the slider-holding frame further comprises another frame portion that is connected to said frame portion to define an opening.

3. The buckle male part of claim 1, wherein the slider-holding frame comprises a support connected to the frame portion via a hanging portion, the slider being sandwiched between the frame portion and the support.

4. The buckle male part of claim 3, wherein the support is shaped to partially match an outer profile of a top wing or a bottom wing of the slider.

5. The buckle male part of claim 1, wherein the buckle male part further comprises a resin-made spring interconnecting the first and second terminal ends of the first and second buckle arms, and a space between the resin-made spring and the frame portion of the slider-holding frame is set to allow the resin-made spring to touch the frame portion of the slider-holding frame in accordance with bending of the first and second buckle arms in a direction for the first and second buckle arms to approach one another.

6. The buckle male part of claim 1, wherein the slider is detachably held by the slider-holding frame, elastic deformation of the slider-holding frame allowing attachment and detachment of the slider to and from the slider-holding frame.

7. The buckle male part of claim 6, wherein the slider comprises a top wing, a bottom wing, a coupling pillar coupling the top wing with the bottom wing, and a pull-attachment column arranged on a top surface of the top wing.

8. The buckle male part of claim 7, wherein the slider-holding frame includes another frame portion coupled to the frame portion so as to surround the top wing.

9. The buckle male part of claim 1, wherein the first buckle arm includes a first plate-like portion, and the second buckle arm includes a second plate-like portion, the first and second plate-like portions being nipped by fingers, and wherein the first slit is interposed between the first plate-like portion and the frame portion, and the second slit is interposed between the second plate-like portion and the frame portion.

* * * * *